US008196266B2

(12) United States Patent
Stratton-Metzger

(10) Patent No.: US 8,196,266 B2
(45) Date of Patent: Jun. 12, 2012

(54) FASHION ACCESSORY

(76) Inventor: Laura R. Stratton-Metzger, Collinsville, IL (US)

( * ) Notice: Subject to any disclaimer, the term of this patent is extended or adjusted under 35 U.S.C. 154(b) by 928 days.

(21) Appl. No.: 12/195,037

(22) Filed: Aug. 20, 2008

(65) Prior Publication Data

US 2010/0047604 A1 Feb. 25, 2010

(51) Int. Cl.
*A44B 99/00* (2010.01)

(52) U.S. Cl. ..... 24/3.1; 24/482

(58) Field of Classification Search ..... 24/17 B, 24/482, 92, 3.1; 132/273, 275, 276; 36/136
See application file for complete search history.

(56) References Cited

U.S. PATENT DOCUMENTS

| | | | | | |
|---|---|---|---|---|---|
| 1,392,350 | A | | 10/1921 | O'Brien | |
| 1,657,427 | A | * | 1/1928 | Witthaeger | 24/482 |
| 3,829,935 | A | * | 8/1974 | Critchfield | 24/114.3 |
| 4,766,682 | A | | 8/1988 | Malloy, III | |
| 5,100,706 | A | | 3/1992 | Zaweski | |
| 5,209,000 | A | | 5/1993 | Rowland et al. | |
| 5,459,947 | A | | 10/1995 | Lasher | |
| 5,655,272 | A | * | 8/1997 | Young | 24/482 |
| 5,664,439 | A | * | 9/1997 | Dickerson | 63/33 |
| 5,697,387 | A | | 12/1997 | Hanisco | |
| D406,177 | S | | 2/1999 | Milroy | |
| 5,979,085 | A | | 11/1999 | Ross et al. | |
| 6,112,380 | A | | 9/2000 | Dolan et al. | |
| 6,389,659 | B1 | * | 5/2002 | Jacobs | 24/573.09 |
| 6,397,497 | B1 | | 6/2002 | McAtee | |
| 6,688,316 | B1 | * | 2/2004 | Klug | 132/286 |
| D516,292 | S | | 3/2006 | Shidler | |
| 2003/0177665 | A1 | | 9/2003 | Monassebian | |
| 2004/0237992 | A1 | * | 12/2004 | Klug | 132/275 |
| 2005/0011087 | A1 | * | 1/2005 | Stevens | 36/136 |
| 2005/0056298 | A1 | * | 3/2005 | McRoberts | 132/276 |
| 2006/0196093 | A1 | | 9/2006 | Krauss | |
| 2007/0083971 | A1 | | 4/2007 | Scully | |
| 2007/0186455 | A1 | | 8/2007 | Lin | |
| 2007/0246059 | A1 | | 10/2007 | Jensen | |
| 2008/0072922 | A1 | * | 3/2008 | Shidler | 132/275 |
| 2009/0032044 | A1 | * | 2/2009 | Grimm | 132/200 |
| 2009/0145455 | A1 | * | 6/2009 | Saponaro | 132/275 |

* cited by examiner

*Primary Examiner* — James Brittain
(74) *Attorney, Agent, or Firm* — McKee, Voorhees & Sease, P.L.C.

(57) ABSTRACT

A fashion accessory for accessorizing an item includes a button operatively connected to a bow and an elastic cording operatively connected to the button and adapted for connecting the fashion accessory, the elastic cording having a first loop for pulling around the button for removably fastening the fashion accessory to the item. A method of fashion accessorizing an item includes providing a fashion accessory comprising a bow, a button operatively connected to the bow, and an elastic cording operatively connected to the button, the elastic cording having a first loop and a second loop and then pulling the first loop and the second loop of the elastic cording around a portion of the item and over the button to thereby secure the fashion accessory in place.

16 Claims, 4 Drawing Sheets

FASHION ACCESSORY

BACKGROUND OF THE INVENTION

The present invention relates to fashion accessories. Fashion accessories enhance or individualize appearance of a person, their clothing, or other items. What is needed is a low cost fashion accessory which is easy to manufacture and which can be used and re-used in a variety of ways.

Therefore it is a primary object, feature, or advantage of the present invention to provide a fashion accessory.

It is a further object, feature, or advantage of the present invention to provide a fashion accessory which may be used to accessorize shoes, sandals, flip-flops, hair headbands, purses, bags, and other items.

It is a still further object, feature, or advantage of the present invention to provide a fashion accessory which is easily attached and easily removed and reused.

Another object, feature, or advantage of the present invention is to provide a fashion accessory which can be low cost and easy to manufacture.

One or more of these and/or other objects, features, or advantages of the present invention will become apparent from the specification and claims that follow.

SUMMARY OF THE INVENTION

According to one aspect of the present invention, a fashion accessory for accessorizing an item includes a button operatively connected to a bow and an elastic cording operatively connected to the button and adapted for connecting the fashion accessory. The elastic cording includes a first loop and may have a second loop for pulling around the button for removably fastening the fashion accessory to the item.

According to another aspect of the present invention, a method of fashion accessorizing an item is provided. The method includes providing a fashion accessory having a bow, a button operatively connected to the bow, and an elastic cording operatively connected to the button. The elastic cording includes at least one loop. The method further includes pulling one or more loops of the elastic cording around a portion of the item and over the button to thereby secure the fashion accessory in place.

According to yet another aspect of the present invention, a method of manufacturing a fashion accessory is provided. The method includes providing a bow, providing an elastic cording, providing a button, forming a first loop and a second loop from the elastic cording, attaching the elastic cording to the bow, and attaching the bow to the button to thereby form the fashion accessory.

DETAILED DESCRIPTION OF PREFERRED EMBODIMENTS

Figure 1:
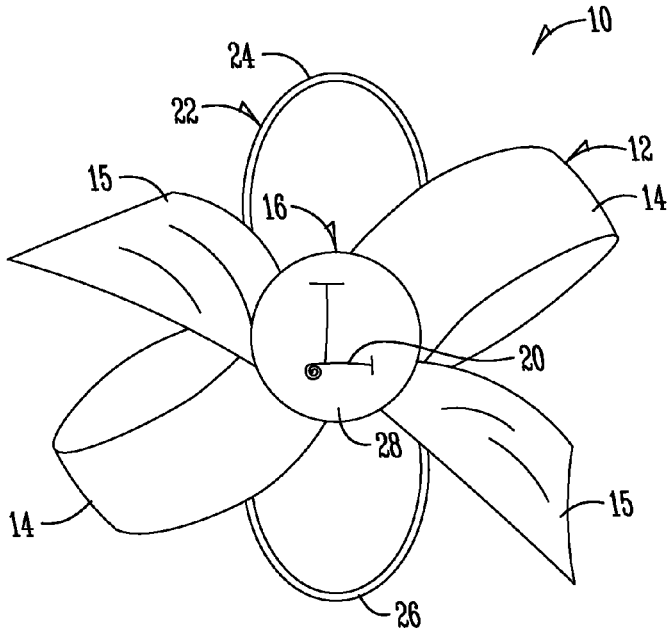
FIG. 1 is front view of a fashion accessory.

FIG. 1 illustrates a front view of one embodiment of the fashion accessory 10. The fashion accessory 10 includes a bow 12. As shown in FIG. 1 the bow 12 includes opposite loops 14 and opposite ends 15 to thereby provide a bow configuration. The bow 12 is preferably formed from a ribbon. A button 16 is positioned at the center of the bow. The button 16 preferably has a covering 28 which may be a fabric covering and there may be a decorative design 20 on the front surface of the button 16 or its covering 28.

An elastic cording 22 extends from the button 16, preferably the elastic cording has a first loop 24 and a second loop 26. In operation, the elastic cording is wrapped around a portion of an item to which the fashion accessory is attached and then the first loop 24 and the second loop 26 are wrapped around the button to secure the fashion accessory 10 in place.

Figure 2:
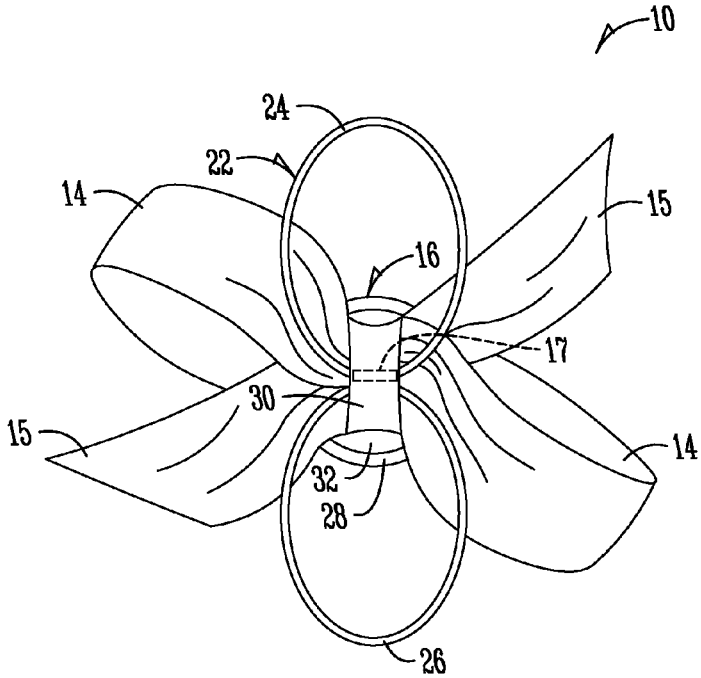
FIG. 2 is rear view of the fashion accessory.

FIG. 2 illustrates a rear view of the fashion accessory shown in FIG. 1. Note a rear surface 32 of the button 16 is shown. The button 16 may be a two piece button to more conveniently facilitate covering of the button 16 with a fabric or other material. In addition a wrap 30 is shown which threads a hook of the button 17 which extends from the rear surface of the button 16.

Figure 3:
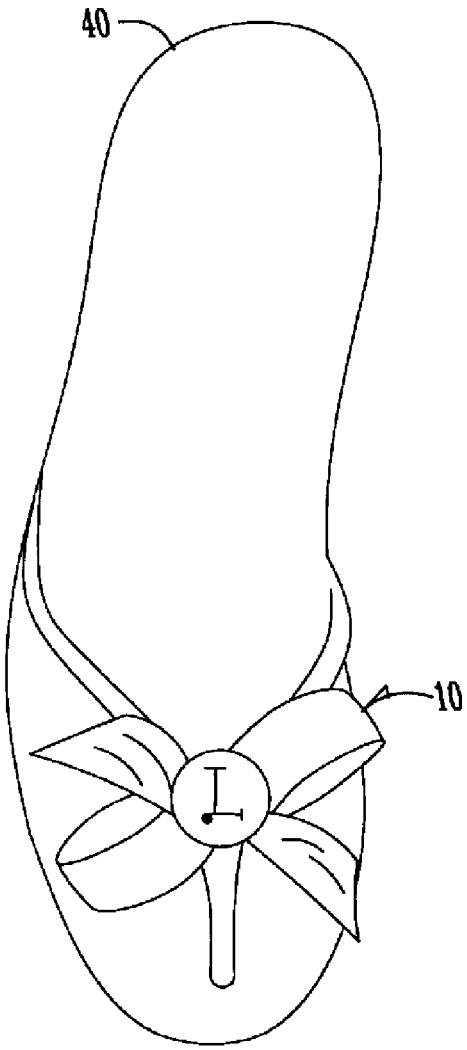
FIG. 3 is a top view of a flip-flop with the fashion accessory.

The fashion accessory 10 may be easily attached to a variety of different items. FIG. 3 illustrates a flip-flop 40 with the fashion accessory 10 in place. The use of the fashion accessory 10 on the flip-flop may provide a number of benefits. For example, the fashion accessory 10 may make the casual and inexpensive flip-flop seem more decorative, fancy, and expensive looking. In addition the fashion accessory 10 may be color coordinated with other elements of the wardrobe such that a single pair of flip-flops may be coordinated with many different outfits or worn on many different occasions by changing the fashion accessory attached to the flip-flop. For example, one may wear a single $3.00 pair of flip flops with a fashion accessory with team colors to a Saturday football game, then switch to a solid black fashion accessory for a nice dinner in the evening, and in the morning change the fashion accessory to a red polka dot fashion accessory to coordinate with a red outfit.

Figure 4:
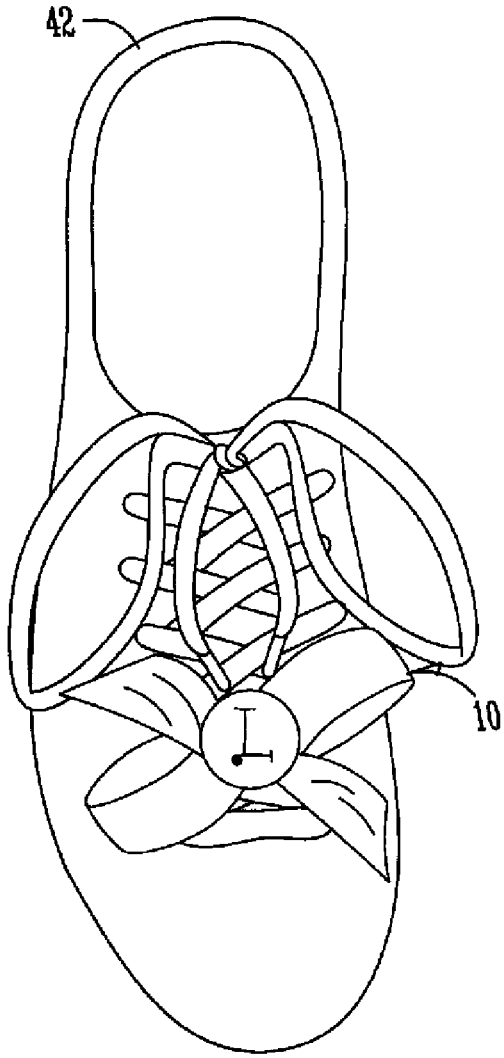
FIG. 4 is a top view of another shoe with the fashion accessory.

FIG. 4 illustrates how a shoe 42 may be accessorized with the fashion accessory 10. The shoe 42 is a lace-up shoe which may be an athletic shoe, casual shoe, or other type of lace-up shoe. To fasten the accessory to the shoe 10, the elastic cording of the fashion accessory may be wrapped around laces of the shoe 42, eyelets of the shoe 42, or other structures of the shoe and then over the button of the fashion accessory.

Figure 5:
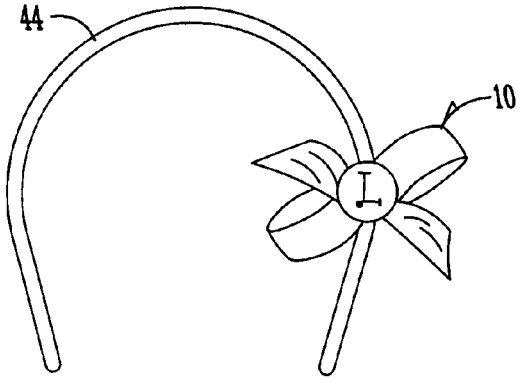
FIG. 5 is front view of a hairband with the fashion accessory.

FIG. 5 illustrates a hairband 44 which is accessorized with the fashion accessory 10. To fasten the fashion accessory 10, the elastic cording of the fashion accessory may be wrapped around the hairband and then over the button of the fashion accessory. Thus, even a simple hairband may be accessorized to coordinate with other items worn by the individual.

Figure 6:
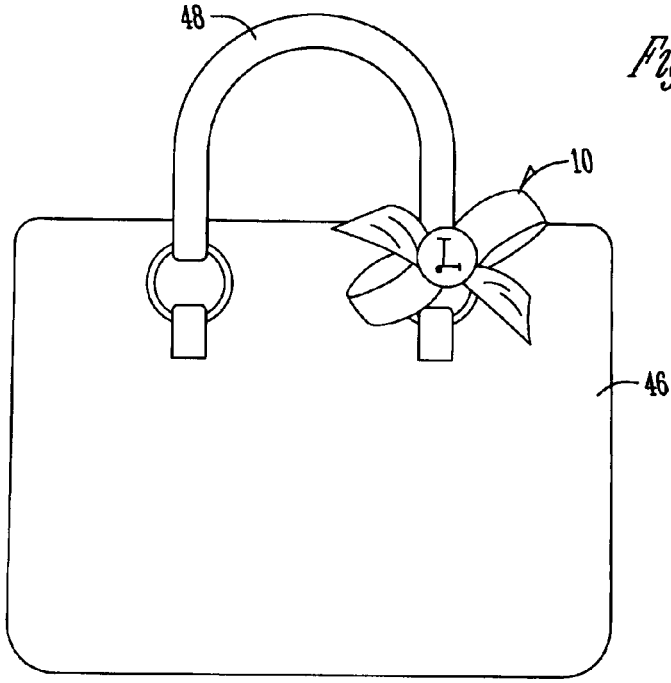
FIG. 6 is a view of a hand bag with the fashion accessory.

FIG. 6 illustrates a hand bag 46 with a strap 48. The fashion accessory 10 is removably connected to the hand bag 46, such as by wrapping one or more of the elastic cording loops of the fashion accessory around the strap 48, a buckle, a loop, or other structure of the hand bag and then around the button of the fashion accessory 10.

Figure 7:
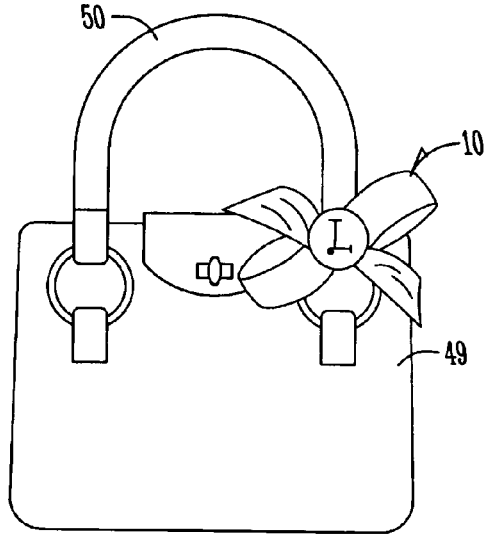
FIG. 7 is a view of a purse with the fashion accessory.

FIG. 7 illustrates a purse 49 with a strap 50. The fashion accessory 10 is removably connected to the purse 49 such as by wrapping one or more of the elastic cording loops of the fashion accessory around the strap 50, a buckle, a loop, or other structure of the purse and then around the button of the fashion accessory 10.

Figure 8:
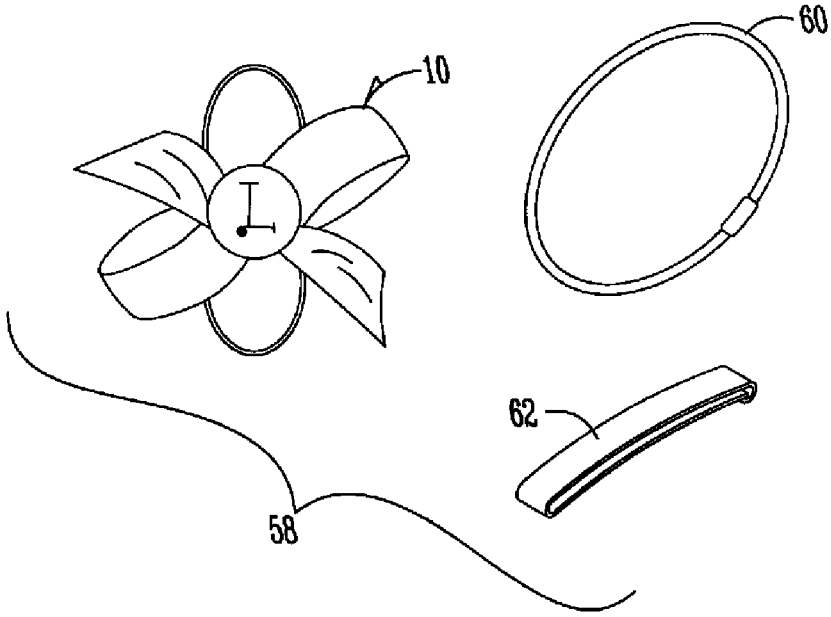
FIG. 8 is a view of hair items with the fashion accessory.

FIG. 8 illustrates another embodiment of the present invention wherein the fashion accessory 10 is affixed to a barrette or hairclip 62. The hairclip 62 may be covered with a ribbon or fabric. The fashion accessory 10 may also be attached to a basic hairband 60 such as may be used to retain a ponytail. In this way, the fashion accessory may be used as a hair accessory.

Figure 9:
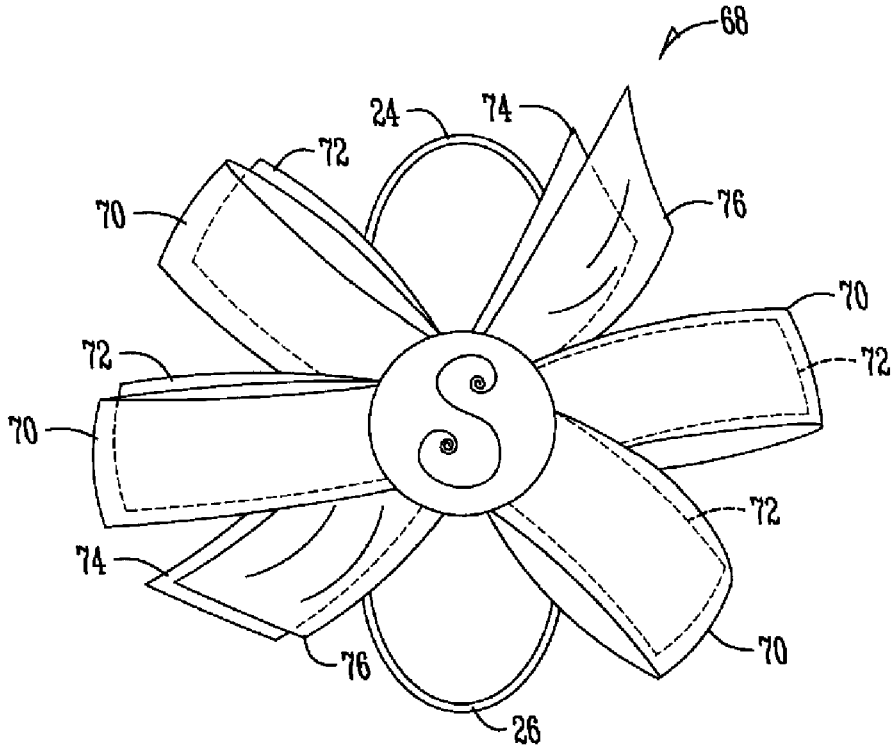
FIG. 9 is a view of another embodiment of the fashion accessory.

As is apparent from FIG. 1 to FIG. 8, the present invention contemplates that the fashion accessory 10 may be connected to any number of different items. Examples of such items include, without limitation, shoes, sandals, flip-flops, CROCS plastic clogs, hair headbands, purses, bags, backpacks, luggage, carriers, and other items. Another use of the fashion accessory is as a bow on a gift. Thus, the fashion accessory improves the appearance of the gift and then can also, of course, be used as a fashion accessory. The fashion accessory may be constructed in many different sizes, colors, styles, and configurations. The fashion accessory may include customized or even personalized insignia such as, but not limited, to logos, initials, symbols, or artwork. For example, one supporting their favorite athletic team may sport fashion accessories with team logos and/or team colors on their shoes, hairbands, purses, or other items to show their support of the athletic team. The color, pattern, or design of the bow and the color, pattern, or design of the button allow for great flexibility in the appearance of the fashion accessory. In addition, the number of loops of the bow may vary, the length of the bows, the size of the button, and other variations allow for variations in the appearance of the fashion accessory. FIG. 9 illustrates another example of a fashion accessory 68 which includes multiple layer ribbons. Thus, loops 72 are under loops 70 and ends 74 are under ends 76. Of course, numerous other variations exist.

The fashion accessory may be constructed in various ways. The particular methodology by which the fashion accessory is constructed may vary based on specific features of the fashion accessory, available materials, and other variations. It should be appreciated that although sizes and dimensions are provided, any number of sizes and dimensions of components may be used.

In one embodiment, the materials used in the assembly of the fashion accessory include a ribbon, a small rubber band, cording, a button, a covering, a fray preventing glue, tape, and glue. A first step is forming the bow of the fashion accessory. The present invention contemplates that instead of manually forming a bow, the process may be automated. In addition, the present invention contemplates that pre-fabricated bows may be used. The bow may be formed from a ribbon which may be, without limitation a grosgrain ribbon, a satin ribbon, or a ribbon made from other materials. The ribbon length, width, and color may vary depending upon the desired appearance of the fashion accessory. The ribbon may also be used to construct the connecting piece or wrap. A piece of ⅞ inch ribbon may be cut into a length of 11 inches. The ribbon is then folded in half lengthwise and both ends of the ribbon are cut at the same time at a 45 degree angle. While still holding the ribbon, FRAY CHECK or other fray preventing glue is applied to the cut edges of the ribbon. The ribbon is then folded into three sections. While holding the ribbon folded, one may gather in an accordion type manner from one edge to the other, pinching in the center of the folds. The small rubber band is then applied to the center of the folded ribbon. The small rubber band may be stretched and twisted several times to tighten and hold the ribbon in place. The ends of the ribbon may then be pulled to adjust length of the sides so that they are uniform.

The cording component of the fashion accessory may then be formed. The present invention contemplates that pre-fabricated elastic cording crimped into a loop may be used. Alternatively, one may cut a piece of cording into a length of about eight inches. The color of the cording may coordinate with the color of the ribbon. The ends of the cording are then tied in a knot thereby forming the cording into a loop. The elastic cording may then be twisted to form a figure eight with a knot positioned off center of the loops. While still holding the cording in this position, one loop is pulled through the other to create two connected loops (a second knot will form). The loops may then be adjusted to uniform size by pulling the loops outward and moving the original knot to the new center knot. The loose ends of the cording may then be taped at the knot. The cording may then be attached to the bow with a small amount of glue to temporarily hold the cording in place.

The button may then be assembled. The button may be a two piece button and where the button is a two piece button it may be assembled in the conventional way or in accordance with manufacturing instructions. If a covering is to be used, the button should be assembled to form the fashion accessory with the covering.

Next, the bow, cording and button are assembled to form the fashion accessory. To do so, a three inch piece of ⅜ inch ribbon may be cut to use as a wrap. The wrap is then inserted through the button hook on the back of the button. The button may then be placed face down with the ends of the wrap extending. The bow may be placed with the top side down on top of the button and cording circles extending in substantially the same plane as the ends of the wraps. The ends of the wrap may then be pulled through the cording circles. The ends of the wrap may then be glued together by first gluing one end onto the back side of the combined cording and bow and then gluing the other side of the wrap onto the first end of the wrap previously glued down.

The previously described methodology is one method which may be used to construct a fashion accessory. Numerous variations, alternatives, and options are contemplated. For examples, there may be variations in the types of materials used, the sizes of the components, the relative sizes of components, the manner in which the loops of the cording are formed, the type of material for the wrap (where used), the manner of connecting the wrap to the bow, the number of bows or loops on a particular fashion accessory, and other variations. By way of further example, instead of the first and second loops of elastic cording being a part of a single piece of elastic cording, the first and second loops of the elastic cording may be separate pieces of the elastic cording. Although two loops of elastic cording are preferred, the present invention contemplates that more or fewer loops may be used. Although a methodology which may be performed by hand is described, the present invention contemplates that the methodology may be automated in whole or in part and that the various component parts may be pre-fabricated. Where the method is automated, the present invention contemplates additional variations in the components used. For example, the buttons used need not have a button hooks, the wrap need not be used, the band need not be used and glue need not be used. Instead, stitching or rivets may be used for attachment purposes.

Another aspect of the present invention is a process that allows for easily attaching a fashion accessory to shoes, sandals, flip-flops, CROCS plastic clogs, gift packaging, hair headbands, purses, bags, backpacks, and other items. The fashion accessory may be used to alter the appearance of such items and convey a heightened sense of style. To attach the fashion accessory to an item, place the fashion accessory where desired on the item and hold in place with one hand. With the other hand, pull one of the cording loops around the item and over the button to secure one side of the fashion accessory. Do the same with the second cording loop in the opposite direction. To remove the fashion accessory, grasp the last cording loop from underside of the button and pull away from the button. Then do the same with the other loop.

To assist in the process, there may be an indicia or color coding associated with the first loop 24, the second loop 26, or separate indicia or color coding for each loop. The indicia or color coding may be used to indicate the order in which the loops should be secured or unsecured. For example, a marking on the first loop may indicate that it is the first loop to secure when attaching the fashion accessory and the last loop to remove when un-attaching the fashion accessory.

A fashion accessory, methods of manufacturing the fashion accessory, and methods of using the fashion accessory have been now been described. The present invention contemplates numerous variations, alternatives, and options including those discussed herein.

What is claimed is:

1. A fashion accessory for accessorizing an item, the fashion accessory comprising:

a bow;

a button operatively connected to the bow, wherein the button includes a hook;

a wrap, wherein the wrap being positioned through the hook of the button and the wrap being attached to the bow;

an elastic cording operatively connected to the button and adapted for connecting the fashion accessory, the elastic cording having a first loop for pulling around the button for removably fastening the fashion accessory to the item.

2. The fashion accessory of claim 1 wherein the elastic cording further comprises a second loop for pulling around the button for further removably fastening the fashion accessory to the item.

3. The fashion accessory of claim 1 wherein the button is a two-piece button and further comprising a covering over the button.

4. The fashion accessory of claim 3 wherein the covering includes a decorative design.

5. The fashion accessory of claim 3 wherein the covering is a fabric covering.

6. The fashion covering of claim 5 further comprising an embroidered design on the fabric covering.

7. The fashion covering of claim 6 wherein the embroidered design includes at least one of a name, initials, a school logo, a sporting team logo, a sporting game symbol, a mascot, sorority letters, a holiday symbol, or a cartoon character.

8. The fashion accessory of claim 4 wherein the decorative design includes an insignia.

9. The fashion accessory of claim 1 wherein the item is from a set consisting of a shoe, a sandal, a flip-flop, a hair headband, a backpack, a plastic clog, a gift package, a bag, and a purse.

10. The fashion accessory of claim 1 wherein the bow comprises a ribbon.

11. A method of fashion accessorizing an item, the method comprising:

providing a fashion accessory comprising (a) a bow, (b) a button operatively connected to the bow, wherein the button includes a hook, (c) a wrap, wherein the wrap being positioned through the hook of the button and the wrap being attached to bow, and (d) an elastic cording operatively connected to the button and adapted for connecting the fashion accessory to the item, the elastic cording having a first loop for pulling around the button for removably fastening the fashion accessory to the item;

pulling the first loop of the elastic cording around a portion of the item and over the button to thereby secure the fashion accessory in place.

12. The method of claim 11 wherein the elastic cording further comprises a second loop, the method further comprising pulling the second loop of the elastic cording around the portion of the item and over the button to thereby further secure the fashion accessory.

13. The method of claim 12 further comprising removing the fashion accessory by pulling the first loop and the second loop from the button.

14. The method of claim 11 wherein the item is from a set consisting of a shoe, a sandal, a flip-flop, a hair headband, a backpack, a plastic clog, a gift package, a bag, and a purse.

15. The method of claim 11 wherein the fashion accessory further comprises a decorative design on the button.

16. A fashion accessory for accessorizing an item, the fashion accessory comprising:

a button, the button having a hook on a rear surface of the button;

a bow operatively connected at the rear surface of the button;

an elastic cording operatively connected to the button and adapted for connecting the fashion accessory to an item, the elastic cording having a first loop and an opposite second loop, each of the first loop and the second loop configured to pull around the button for removably fastening the fashion accessory to the item;

a wrap threading the hook of the button and extending through both the first loop and the opposite second loop.

* * * * *